United States Patent [19]

Powell

[11] 4,034,950

[45] July 12, 1977

[54] FORM TIE

[76] Inventor: John M. Powell, 5169 Alum Rock Ave., San Jose, Calif. 95127

[21] Appl. No.: 724,714

[22] Filed: Sept. 20, 1976

Related U.S. Application Data

[63] Continuation-in-part of Ser. No. 621,647, Oct. 14, 1975, abandoned.

[51] Int. Cl.[2] ..... E04G 17/08

[52] U.S. Cl. ..... 249/46; 249/216

[58] Field of Search ..... 249/40, 41, 43–46, 249/190, 191, 213–216, 218

[56] References Cited

U.S. PATENT DOCUMENTS

| | | | |
|---|---|---|---|
| 1,097,796 | 5/1914 | Fuehrer | 249/215 |
| 1,729,807 | 10/1929 | Toogood | 249/216 |
| 3,199,827 | 8/1965 | Terry | 249/41 |

FOREIGN PATENT DOCUMENTS

| | | | |
|---|---|---|---|
| 457,038 | 5/1950 | Italy | 249/44 |

*Primary Examiner*—Francis S. Husar
*Assistant Examiner*—John McQuade
*Attorney, Agent, or Firm*—Phillips, Moore, Weissenberger, Lempio & Majestic

[57] ABSTRACT

An article of manufacture for fixing the sides of a form with respect to each other is disclosed, which article consists of a unitary elongated metal member of generally Z-shape configuration having generally parallel end portions joined by an intermediate diagonal portion. Specific structural features of the article are described which provide improved resistance to vertical and horizontal shear forces acting on the form sides in addition to resisting transverse forces which tend to move the form sides toward or away from each other.

3 Claims, 5 Drawing Figures

FORM TIE

CROSS-REFERENCE TO RELATED APPLICATION

This application is a continuation-in-part of my prior patent application Ser. No. 621,647filed Oct. 14, 1975, now abandoned and entitled FORM TIE.

BACKGROUND OF THE INVENTION

This invention relates to forms for concrete and the like and more particularly to an improved unitary article of manufacture for use in assembling such forms in the field.

In constructing walls, foundations, curbs and the like of concrete or similar initially fluid materials which subsequently harden into the desired structure, it is common to fabricate a form consisting of spaced sides or panels defining the exterior side surfaces of the desired structure. It has been proposed in the prior art to provide elongated metal members or form ties adapted to extend between the sides or panels of a form and temporarily tie the sides or panels of the form to each other while concrete, for example, is poured into the form and allowed to harden. Such form ties are thus embedded in the concrete and means are provided for the subsequent release of the form sides from the form ties so that the form sides or panels may be removed for reuse.

U.S. Pat. Nos. 1,097,796 (Fuehrer) and 1,729,807 (Toogood) are representative of prior art form ties. However, the form tie disclosed by Fuehrer will not resist either shear forces or transverse forces acting on the form sides unless used in pairs at given locations to form an X-shape configuration. The form tie disclosed by Toogood will resist transverse forces acting on the form sides when used alone at a given location but will not resist shear forces even if more than one is used at a given location.

It is an object of this invention to provide a unitary form tie which will resist both shear and transverse forces acting on the form sides at a given location when used by itself at such given location.

U.S. Pat. No. 3,199,827 (Terry) discloses a preassembled multi-element form tie which includes a pair of elements similar to the form tie described by Toogood interconnected by additional elements adapted to resist vertical shear forces. However, the form tie disclosed by Terry is not as effective as a pair of form ties as disclosed by Fuehrer of comparable size in resisting vertical shear forces even though it is more complicated in structure.

It is an object of this invention to provide a unitary form tie which will provide resistance to vertical shear forces acting on the form sides at a given location approaching maximum for its size when used by itself at such given location.

It will be noted that none of the form ties of the prior art provide resistance to horizontal shear forces acting on the form sides.

It is an object of this invention to provide a unitary form tie which may be oriented to resist horizontal shear forces acting on the form sides in addition to resisting vertical shear forces and transverse forces acting on the form sides.

SUMMARY OF THE INVENTION

According to this invention, a pair of form sides are fixed in selected spaced position with respect to each other against shear and transverse forces acting on such pair of form sides at a given location by means of a form tie comprising a unitary elongated metal member of generally Z-shape configuration. Thus, according to this invention, the form tie has generally parallel end portions joined by an intermediate diagonal portion with the free end of each end portion having a bight formed therein terminating in a rectilinear tab extending transversely of the end portion. The other end of each end portion has a bight formed therein and a rectilinear brace portion interposed between the bight and the intermediate diagonal portion of the member. Such interposed rectilinear brace portions extend substantially normal to the generally parallel end portions of the Z-shaped metal member.

BRIEF DESCRIPTION OF THE DRAWING

The foregoing and other objects and features of the subject invention will be more fully understood from a reading of the following detailed description of preferred embodiments thereof in conjunction with the attached drawing wherein.

DESCRIPTION OF PREFERRED EMBODIMENTS

Figure 1:
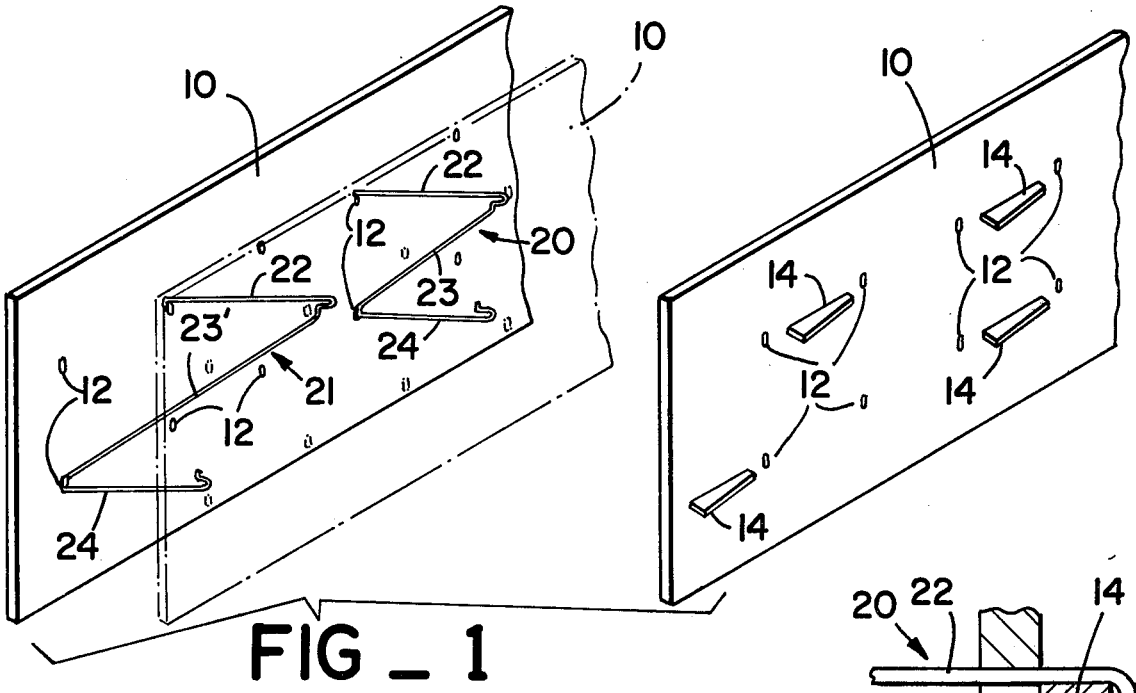
FIG. 1 is an exploded perspective view showing a pair of form sides and their interconnection by means of two form ties in two different positions according to the teaching of this invention.

Referring to FIG. 1, the teaching of this invention is shown as applied to the fabrication of forms for use in constructing walls, foundations, curbs and the like of concrete, for example. It is common in the prior art to fabricate forms for concrete of plywood panels 10 as shown in exploded view in FIG. 1. Thus, each of the panels 10 is provided with a plurality of holes therethrough in spaced array which may be aligned with the spaced array of holes in the other panel to receive therethrough the ends of a prefabricated form tie structure as disclosed in U.S. Pat. No. 3,199,827 mentioned hereinabove. In accordance with the teaching of the prior art, the ends of the prefabricated form tie structure may include bight portions terminating in transverse tabs and adapted to extend through the holes 12 a sufficient distance to receive wedges 14 by means of which the panels may be removably affixed to the prefabricated form tie structures.

In accordance with the teaching both of the prior art and this application, the panels 10 are assembled in fixed spaced relation with respect to each other as indicated by dotted lines in FIG. 1 by means of form ties and concrete or the like is introduced therebetween. After the concrete or the like has hardened, the form ties will be embedded therein but the panels 10 may be removed for reuse by removing the wedges 14 to free the panels 10 from the form ties. The prefabricated form tie structures of the prior art have been complicated in their structure and assembly and have tended to require an excess of material in order to provide adequate resistance to transverse forces acting on the panels 10 and tending to move the panels 10 toward or away from each other. However, the prefabricated form tie structures of the prior art have been deficient in providing resistance to shear forces acting on the panels 10 and tending to move the panels 10 in the planes of their major surfaces.

According to the teaching of this invention, form ties 20,21 comprising a simple unitary prefabricated elongated metal member is provided. Such form ties 20,21 provide a resistance to both transverse forces and shear forces acting on the panels at the location of the tie which approaches maximum for the amount of material used in the form tie.

Thus it will be seen that the form ties 20,21 according to the teaching of this invention comprise an elongated metal member such as heavy gauge wire formed into a generally Z-shape configuration. Thus the form tie 20,21 includes generally parallel end portions 22, 24 interconnected by an intermediate diagonal portion 23,23'. The only difference between the form ties 20 and 21 is that the diagonal portion 23' of the form tie 21 is longer than the diagonal portion 23 of the form tie 20.

Figure 2:
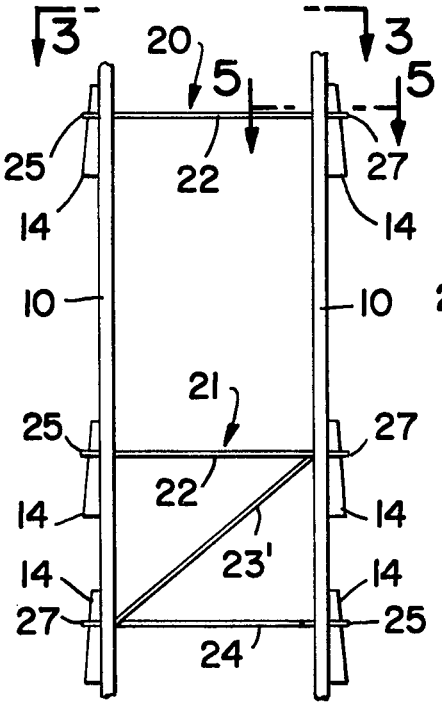
FIG. 2 is a top plan view of the form sides and form ties of FIG. 1 as fully assembled.

Thus, as shown in FIGS. 1 and 2 of the drawing, the form tie 20 is adapted to be positioned vertically between the panels 10 for interconnection therewith whereas the form tie 21 is adapted to be positioned at an angle to the vertical between the panel members 10 for interconnection therewith. As will be more fully described hereinafter, a form tie structure in accordance with the teaching of this invention when in the position of the form tie 20 will resist vertical shear forces exerted on the panels 10 in addition to resisting transverse forces tending to move the panels 10 toward or away from each other. Similarly, as will be more fully described hereinafter, a form tie in accordance with the teaching of this invention in the position of form tie 21 will resist both vertical and horizontal shear forces exerted on the panels 10 in addition to resisting transverse forces tending to move the panel members 10 toward and away from each other.

Figure 3:
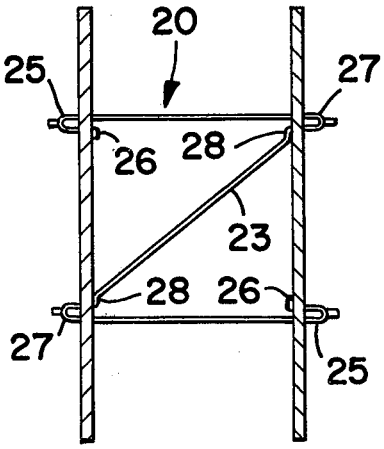
FIG. 3 is a cross-sectional view taken along line 3—3 of FIG. 2.

As best shown in FIGS. 2 and 3, the free ends of the end portions 22 and 24 of the form ties 20,21 each have a bight 25 formed therein which terminates in a tab 26 extending transversely of the end portion 22,24. Similarly, the other end of each end portion 22,24 of the form ties 20,21 each have a bight 27 formed therein with a rectilinear brace portion 28 interposed between the bight 27 and the intermediate diagonal portion 23 of the form tie 20,21. The rectilinear brace portion 28 extends substantially normal to the generally parallel end portions 22 and 24 of the form tie 20,21 and is an essential feature of the teaching of this invention.

Figure 5:
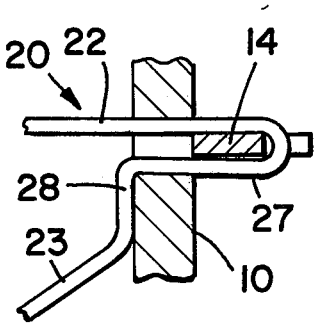
FIG. 5 is an enlarged cross-sectional view taken along line 5—5 of FIG. 2.

As best shown in FIGS. 2, 3 and 5, the bight portions 25 and 27 of the form tie 20,21 are inserted through holes 12 in the panels 10. The wedge members 14 are then inserted through the projecting portions of the bights 25 and 27 to lock the panels 10 compressively against the tabs 26 and rectilinear brace portions 28 respectively. Thus transverse forces exerted on the panels 10 tending to move them toward each other will place the end portions 22,24 of the form tie 20,21 in compression and transverse forces exerted on the panel members 10 tending to move them away from each other will place the end portions 22,24 of the form tie 20,21 in tension and any movement of the panels 10 toward or away from each other will be resisted. According to this invention, shear forces exerted on the panels 10 will tend to place the intermediate portion 23 of the form tie 20,21 in tension or compression due to the presence of the rectilinear brace portion 28. As best shown in FIG. 5, such rectilinear brace portions 28 extend along the interior surfaces of the panels 10 and thus avoid the cantilever type interconnection of the prior art.

It will be understood that a plurality of form ties 20,21 may be used in a plurality of vertical and horizontal rows in interconnecting panels for a given form. Thus the positions of the plurality of form ties 20,21 may be varied with respect to each other to provide resistance approaching optimum to both shear and transverse forces while utilizing a total amount of material which approaches the minimum.

Figure 4:
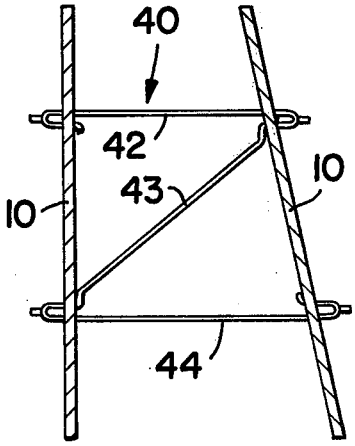
FIG. 4 is a cross-sectional view similar to FIG. 3 but showing a further embodiment of this invention.

Referring to FIG. 4, a form tie 40 according to the teaching of this invention is shown which is adapted to interconnect panels 10 at an angle with respect to each other. Thus, one of the end portions 42 of the form tie 40 is shorter than the other end portion 44 thereof. There remainder of the form tie 40 is identical to form ties 20 and 21, it being understood that the intermediate diagonal portion 43 of the form tie 40 may have a length with respect to the spacing of the holes 12 in the panels 10 to enable it to be positioned either as is form tie 20 or as is form tie 21. Other obvious modifications may be made without departing from the teaching of this invention and within the scope of the following claims.

I claim:

1. A unitary form tie for use in fixing a pair of form sides in a selected spaced position with respect to each other at a given location against shear and transverse forces acting on said pair of form sides at said given location, said form tie comprising a unitary elongated metal member of a generally Z-shape configuration having generally parallel end portions joined by an intermediate diagonal portion, the free end of each said end portion having a bight formed therein terminating in a rectilinear tab extending transversely of said end portion, the other end of each end portion having a bight formed therein and a rectilinear brace portion interposed between said bight at the other end of each end portion and said intermediate diagonal portion of said member, said rectilinear brace portions extending substantially normal to said generally parallel end portions of said metal member of generally Z-shape configuration.

2. A unitary form tie as claimed in claim 1 wherein one end portion of said elongated metal member is of different length from the length of the other end portion thereof.

3. In combination, a pair of spaced panels of given thickness having aligned arrays of spaced holes therethrough providing the sides of a form for concrete or the like and a plurality of form ties interconnecting said panels and affixed thereto by means of plurality of wedges, each of said plurality of form ties comprising a unitary elongated metal member of a generally planar Z-shape configuration having generally parallel end portions joined by an intermediate diagonal portion all lying in a common plane, the free end of each of said end portions having a bight formed therein of depth greater than said given thickness of said panels and terminating in a tab extending transversely of said end portion, the other end of each of said end portions having a bight formed therein of depth greater than said given thickness of said panels and a rectilinear brace portion interposed between said bight at the other end of each of said end portions and said intermediate diagonal portion of said member, said rectilinear brace portions extending substantially normal to said generally parallel end portions of said metal member of generally Z-shape configuration, said bights at said free ends of said end portions each being received through one hole of said array of holes in a different one of said panels, said bights at the other ends of said end portions each being received through a different hole of said array of holes in a different one of said panels, and each of said bights at said free ends and said other ends of said end portions receiving a different one of said plurality of wedges therethrough on the exterior sides of said panels with said tabs and said rectilinear brace portions in contact with the interior sides of said panels whereby each of said form ties resist shear and transverse forces acting on said panels.

* * * * *